US009164416B2

(12) United States Patent
Nakamura et al.

(10) Patent No.: US 9,164,416 B2
(45) Date of Patent: Oct. 20, 2015

(54) CONDUCTIVE MEMBER, ELECTROPHOTOGRAPHIC PROCESS CARTRIDGE, AND ELECTROPHOTOGRAPHIC APPARATUS

(75) Inventors: Minoru Nakamura, Mishima (JP); Kazuaki Nagaoka, Susono (JP); Yosuke Ata, Suntou-gun (JP); Masahiro Inami, Tagata-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/342,332

(22) PCT Filed: Aug. 29, 2012

(86) PCT No.: PCT/JP2012/005433
§ 371 (c)(1),
(2), (4) Date: Feb. 28, 2014

(87) PCT Pub. No.: WO2013/031206
PCT Pub. Date: Mar. 7, 2013

(65) Prior Publication Data

US 2014/0212168 A1 Jul. 31, 2014

(30) Foreign Application Priority Data

Sep. 1, 2011 (JP) ..... 2011-190688

(51) Int. Cl.
*G03G 15/06* (2006.01)
*G03G 15/08* (2006.01)

(52) U.S. Cl.
CPC ..... *G03G 15/065* (2013.01); *G03G 15/0818* (2013.01)

(58) Field of Classification Search
CPC combination set(s) only.
See application file for complete search history.

(56) References Cited

U.S. PATENT DOCUMENTS 6,004,669 A * 12/1999 Rokutan et al. ..... 428/335
2009/0081573 A1* 3/2009 Iwazaki et al. ..... 430/108.7

FOREIGN PATENT DOCUMENTS

| | | | |
|---|---|---|---|
| JP | 07-261542 | A | 10/1995 |
| JP | 2002-055522 | A | 2/2002 |
| JP | 2002-147437 | A | 5/2002 |
| JP | 2004-037551 | A | 2/2004 |
| JP | 2008-107820 | A | 5/2008 |
| JP | 2009-109745 | A | 5/2009 |

* cited by examiner

*Primary Examiner* — Clayton E Laballe
*Assistant Examiner* — Jas Sanghera
(74) *Attorney, Agent, or Firm* — Canon USA, Inc. I.P. Division

(57) ABSTRACT

The present invention provides a conductive member in which it is possible to control a variation in resistance due to physical stress from a contact member, and an uneven density in a halftone image can be prevented.
The conductive member is a development roller which includes a conductive shaft core, a conductive elastic layer, and a conductive surface layer. The conductive elastic layer contains silicone rubber and a basic carbon black dispersed in the silicone rubber. The surface layer contains a urethane resin having a carboxyl group in its molecule and an acidic carbon black dispersed in the urethane resin.

5 Claims, 3 Drawing Sheets

CONDUCTIVE MEMBER, ELECTROPHOTOGRAPHIC PROCESS CARTRIDGE, AND ELECTROPHOTOGRAPHIC APPARATUS

TECHNICAL FIELD

The present invention relates to a conductive member, an electrophotographic process cartridge, and an electrophotographic apparatus.

BACKGROUND ART

There is known a development roller used for contact development having a structure including an elastic layer to which electrical conductivity is imparted by dispersing a carbon black. PTL 1 proposes that by adjusting properties of such a carbon black, it is possible to suppress a variation in resistance when a DC voltage is continuously applied to a development roller.

CITATION LIST

Patent Literature

PTL 1: Japanese Patent Laid-Open No. 2009-109745

SUMMARY OF INVENTION

Technical Problem

In accordance with the studies of the present inventors, it has been found that, although the variation in resistance due to the variation in the dispersion state of a carbon black in an elastic layer can be suppressed by selection of an appropriate carbon black, there is a variation in resistance due to the layer structure. That is, in some cases, a development roller or charging roller may include a conductive surface layer, in which a carbon black is dispersed for the purpose of suppressing toner adhesion and the like, provided on a conductive elastic layer.

In such a conductive roller including a conductive elastic layer and a conductive surface layer which covers the surface of the conductive elastic layer, it has been found that, even in the case where measures are provided against the variation in resistance due to the presence of carbon black in the elastic layer, the electrical resistance may increase with time in some cases.

An object of the present invention is providing a conductive member which has a layered structure including an elastic layer and a surface layer covering the elastic layer, the elastic layer and the surface layer each being imparted with electrical conductivity by dispersing a carbon black, and in which an increase in electrical resistance with time is suppressed. Furthermore, an object of the present invention is providing a process cartridge and an electrophotographic apparatus, each of which is capable of forming a stable, high-quality electrophotographic image.

Solution to Problem

The present invention relates to a conductive member which includes a conductive shaft core, a conductive elastic layer, and a conductive surface layer and which is used for electrophotography. The conductive elastic layer contains silicone rubber and a basic carbon black dispersed in the silicone rubber. The conductive surface layer contains a urethane resin having a carboxyl group in its molecule and an acidic carbon black dispersed in the urethane resin.

Furthermore, the present invention relates to an electrophotographic process cartridge which includes an image bearing member configured to bear an electrostatic latent image, a charging unit configured to perform primary charging on the image bearing member, a developing unit configured to form a toner image by developing the electrostatic latent image with a toner, and a cleaning unit configured to clean the surface of the image bearing member, the electrophotographic process cartridge being configured to be detachably mountable to a main body of an electrophotographic apparatus, in which the developing unit has the conductive member described above.

Furthermore, the present invention relates to an electrophotographic apparatus which includes an image bearing member configured to bear an electrostatic latent image, a charging unit configured to perform primary charging on the image bearing member, an exposing unit configured to form an electrostatic latent image on the image bearing member on which primary charging has been performed, a developing unit configured to develop the electrostatic latent image to form a toner image, and a transferring unit configured to transfer the toner image to a transfer medium, in which the developing unit has the conductive member described above.

Advantageous Effects of Invention

According to aspects of the present invention, it is possible to provide a conductive member which is used for electrophotography and in which the resistance is not likely to increase from the initial stage to the latter half of an endurance test, and to provide an electrophotographic process cartridge and an electrophotographic apparatus.

DESCRIPTION OF EMBODIMENTS

Figure 1:
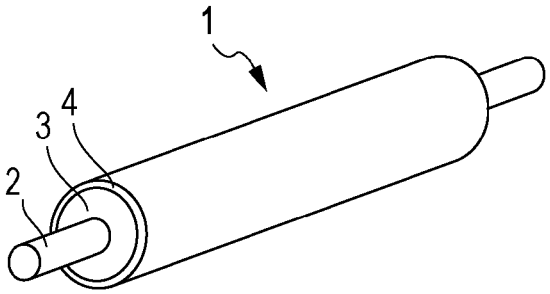
FIG. 1 is a perspective view showing a development roller according to aspects of the present invention.

The present inventors have studied the increase in electrical resistance with time when a roller-shaped conductive member for electrophotography (hereinafter, may also be referred to as a "conductive roller") having a layered structure including an elastic layer and a surface layer covering the elastic layer, the elastic layer and the surface layer each being imparted with electrical conductivity by dispersion of a carbon black, is used as a charging roller for contact charging. It has been observed that the increase in electrical resistance with time is particularly marked in the case where silicone rubber is used for the conductive elastic layer and a urethane resin is used for the conductive surface layer. As a result, it has been found that one of the causes of the problem is shear stress associated with sliding due to rotation and applied from an electrostatic latent image bearing member, a developing blade, or the like with which the conductive roller comes into contact.

That is, the present inventors believe that the mechanism of the increase in resistance with time of the conductive roller having the layered structure is as follows: In a conductive roller having a layered structure including an elastic layer containing a carbon black and a surface layer containing a carbon black, carbon black particles form conductive paths in the thickness direction in each layer. At the interface between the two layers, carbon black particles exposed at the opposing surfaces of the two layers or present in the vicinity thereof form conductive paths, thereby exhibiting conductivity. However, when the bonding strength between the elastic layer and the surface layer is weak, conductive paths at the interface are broken by shear stress from the outside. As a result, transfer of charge is not likely to take place at the interface between the elastic layer and the surface layer, and the electrical resistance increases.

In order to prevent conductive paths at the interface from being broken by shear stress, the present inventors have focused attention on, and conducted a study on the relationships among the carbon black contained in the silicone rubber serving as the conductive elastic layer, the structure of the urethane resin which is a binder resin contained in the conductive surface layer, and the carbon black contained therein.

The present inventors have found that in the case where a basic carbon black is incorporated into silicone rubber and an acidic carbon black is incorporated into a urethane resin having a carboxyl group in its molecule, strong conductive paths are formed at the interface. The present inventors believe that the phenomenon described below occurs in this combination.

The carboxyl groups (acidic groups) present in the urethane resin of the conductive surface layer strongly adsorb to the basic carbon black dispersed in the silicone rubber of the conductive elastic layer because of acid-base interactions. As a result, the bonding strength at the interface between the conductive elastic layer and the conductive surface layer is increased.

In the case where a carbon black other than the acidic carbon black, for example, a basic carbon black, is incorporated into the conductive surface layer, the carboxyl groups of the urethane resin in the conductive surface layer preferentially interact with the basic carbon black. That is, the carboxyl groups in the conductive surface layer, which are to contribute to interactions with the basic carbon black in the conductive elastic layer, are consumed.

In contrast, in the case where the carbon black to be incorporated into the conductive surface layer is an acidic carbon black, the carboxyl groups of the urethane resin in the conductive surface layer can be made to efficiently interact with the basic carbon black in the conductive elastic layer.

In such a manner, in the present invention, since acid-base interactions between the carboxyl groups in the conductive surface layer and the basic carbon black contained in the conductive elastic layer can be maximized, adhesion between the two layers can be increased. As a result, it is assumed that it is possible to form conductive paths that are not easily broken at the interface between the conductive elastic layer and the conductive surface layer.

Conductive Roller

A conductive roller according to aspects of the present invention is shown in FIG. 1.

A conductive roller 1 includes a conductive elastic layer 3 disposed on the outer circumference of a conductive shaft core 2, and a conductive surface layer 4 further disposed on the outer circumference thereof.

As the conductive shaft core 2, any material that has good conductivity may be used.

Usually, a metal cylindrical hollow body or cylindrical solid body having an outside diameter of 4 to 10 mm made of SUS or the like is used.

The conductive roller 1 shown in FIG. 1 can be produced by the method described below. A conductive elastic layer 3 may be formed, for example, by injecting a composition obtained by kneading a basic carbon black and silicone rubber into a cavity of a mold where a conductive shaft core 2 has been placed in advance. Alternatively, a method may be used in which a tube is formed by extrusion or cutting of a slab or block separately formed in advance using the composition, the tube is cut into a predetermined shape and size, and then a conductive shaft core 2 is pressed into the tube to form a conductive elastic layer 3. When desired, the outside diameter may be adjusted to a predetermined value by cutting, grinding, or the like.

A conductive surface layer 4 may be formed by a method in which a coating material is prepared from an acidic carbon black and starting materials for a carboxyl-containing urethane resin, i.e., a polyol and an isocyanate, using a kneader, such as a ball mill, the resulting coating material is applied onto the conductive elastic layer 3, and as necessary, heating treatment is performed thereon.

Figure 2:
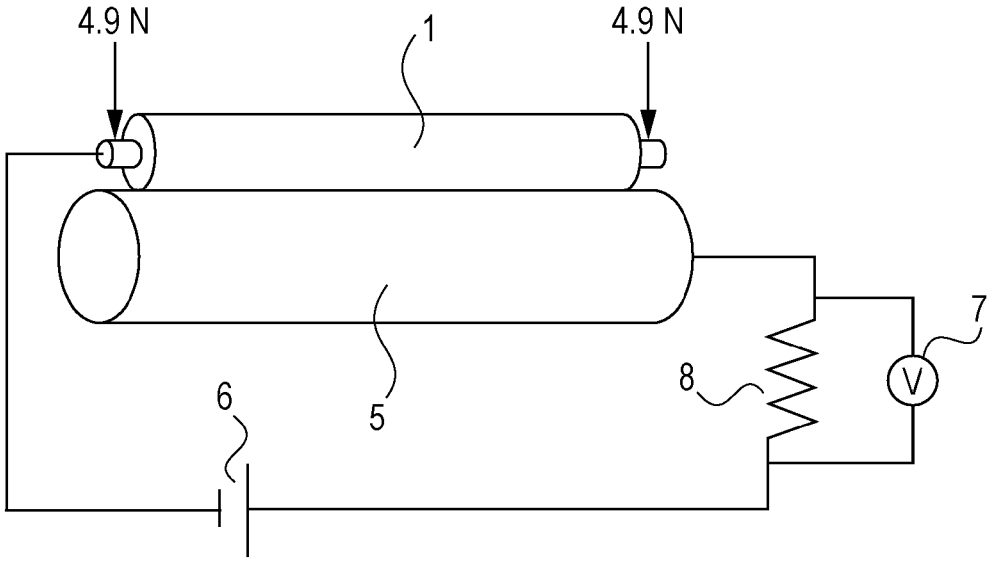
FIG. 2 is a view illustrating a method of measuring the electrical resistance of a development roller according to aspects of the present invention.

The electrical resistance of the conductive roller can be measured by using an electrical resistance measuring instrument shown in FIG. 2. That is, a weight of 4.9 N is applied to each end of the metal core of a development roller 1, the development roller 1 is pressed against a metal drum 5 with a diameter of 30 mm, and while the development roller 1 is being driven to rotate at a number of roller rotations of 1 rps, a voltage of 50 V is applied by a power source 6. The voltage applied to a resistor 8 (1 kilo ohm), which is shown in a voltmeter 7, is recorded 3,000 times in 30 seconds, and an arithmetic average thereof is obtained. The electrical resistance of the conductive roller 1 can be determined from the resulting value in accordance with Ohm's law.

Conductive Elastic Layer

The conductive elastic layer 3 can be rich in elasticity in order to stably secure a nip width with an image bearing member and to continuously output uniformity in image and a stable image for a long period of time. In the present invention, the conductive elastic layer 3 is composed of silicone rubber. Furthermore, the conductive elastic layer 3 is incorporated with a conductivity-imparting agent, and is adjusted so as to have an appropriate resistance. Usually, the resistance of the conductive elastic layer 3 is adjusted in the range of $10^3$ to $10^{10}$ ohm.

In the present invention, it is essential to use a basic carbon black as a conductivity-imparting agent. In particular, the basic carbon black can have a pH of 9.0 to 10.0 from the standpoint that the interactions with a urethane resin having a carboxyl group in its molecule present in a conductive surface layer 4, which will be described later, increase. Furthermore, as long as a basic carbon black is used, the type of carbon black is not particularly limited, and conductive carbon, carbon for rubber, or carbon for color (ink) may be used. The amount of the basic carbon black contained in the conductive elastic layer is usually in the rage of 3.0 to 20 parts by mass relative to 100 parts by mass of the base material.

In the present invention, the pH of carbon black depends on the number of functional groups on the surface of the carbon black and is an index indicating the acidity or basicity. In general, oxygen-containing functional groups, such as phenolic hydroxyl groups, carboxyl groups, and quinone-type oxygen groups, are present on the surface of a carbon black. It is known that the number of surface functional groups varies depending on the type of carbon black.

The pH of a carbon black can be measured in accordance with the following procedure:

(1) 5 g of Carbon black and 50 ml of distilled water with a pH7 are collected and mixed in a container.

(2) The mixture is boiled for 15 minutes and then cooled to room temperature over 30 minutes.

(3) An electrode of a pH meter "HM30R" (manufactured by DKK-TOA Corporation) is immersed in the supernatant solution of the cooled mixture to measure the pH.

The thickness of the conductive elastic layer 3 is usually in the range of 0.3 to 10 mm, and in particular in the range of 1.0 to 5.0 mm. In the present invention, the thickness of a conductive elastic layer 3 is measured with slide calipers at nine positions on a cross section of a development roller provided with the conductive elastic layer 3, and an arithmetic average thereof is defined as the thickness of the conductive elastic layer 3. When the thickness is small (1.0 mm or less), the cross section is measured at nine positions with a video microscope/magnification 5 times (trade name: VHX-500 manufactured by Keyence Corporation), and an arithmetic average thereof is defined as the thickness.

Conductive Surface Layer

In the present invention, in order to increase interactions with the carbon black of the conductive elastic layer, the base material of the conductive surface layer 4 to be disposed on the outer circumference of the conductive elastic layer 3 is made of a urethane resin having a carboxyl group in its molecule.

The urethane resin can be obtained from a polyol, an isocyanate, and optionally, a chain extender. Examples of the polyol, which is a starting material for the urethane resin, include polyether polyol, polyester polyol, polycarbonate polyol, polyolefin polyol, acrylic polyol, and mixtures of these. Examples of the isocyanate, which is a starting material for the urethane resin, include tolylene diisocyanate, diphenylmethane diisocyanate, naphthalene diisocyanate, tolidine diisocyanate, hexamethylene diisocyanate, isophorone diisocyanate, phenylene diisocyanate, xylylene diisocyanate, tetramethylxylylene diisocyanate, cyclohexane diisocyanate, and mixtures of these. Examples of the chain extender, which is a starting material for the urethane resin, include difunctional low-molecular-weight diols, such as ethylene glycol, 1,4-butanediol, and 3-methylpentanediol, trifunctional low-molecular-weight triols, such as trimethylol propane, and mixtures thereof.

In order to incorporate carboxyl groups into the urethane resin, a half ester copolymerization method which uses a half ester synthesized from a polyol and an acid anhydride may be used. Alternatively, a compound having two hydroxyl groups and one or more carboxyl groups may be copolymerized during the urethane formation reaction. The molecular structure of the urethane resin having a carboxyl group in its molecule can be identified using a technique, such as pyrolysis GC/MS, NMR, IR, or elementary analysis.

Figure 3:
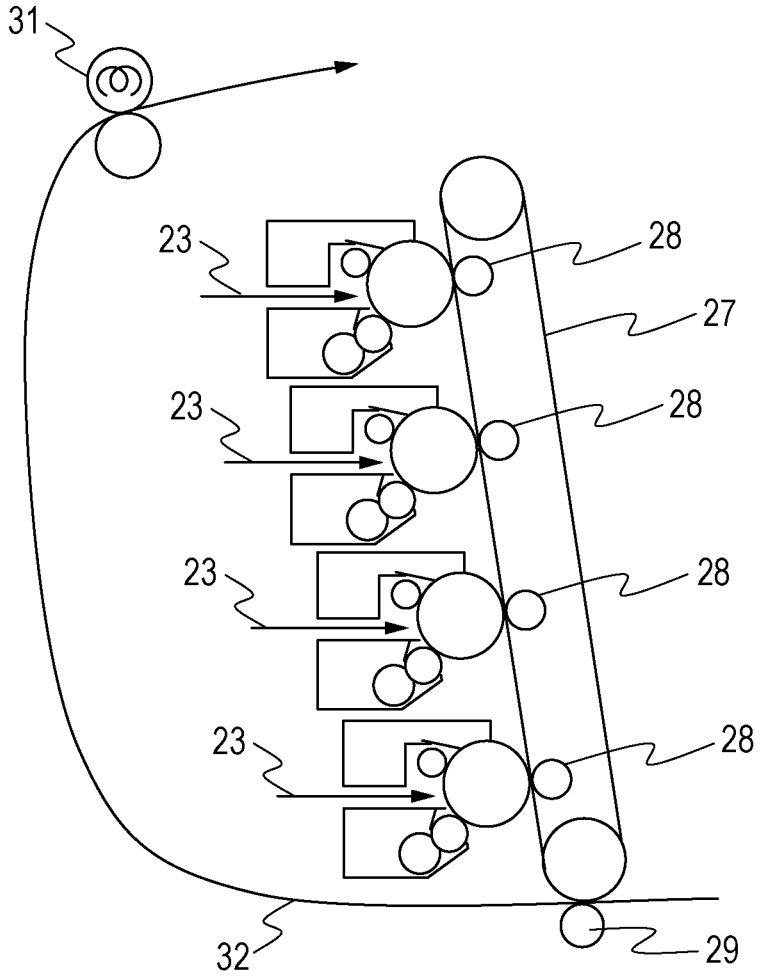
FIG. 3 is a cross-sectional view schematically showing an electrophotographic apparatus according to aspects of the present invention.
Figure 4:
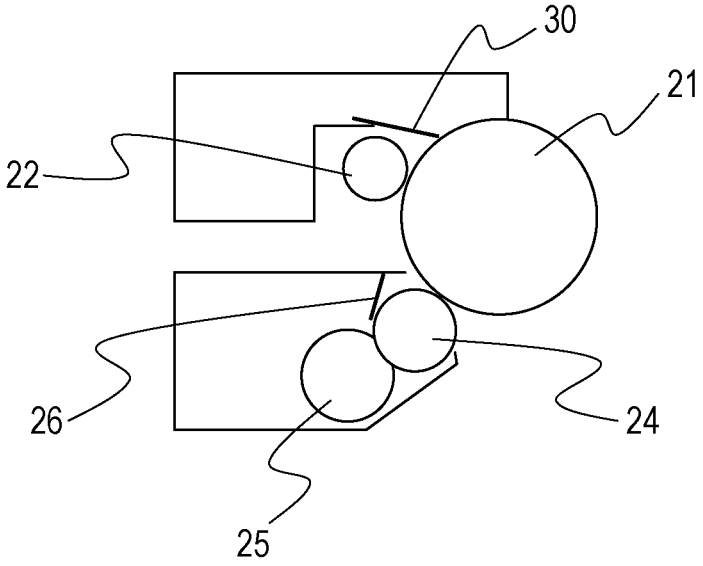
FIG. 4 is an enlarged cross-sectional view showing an electrophotographic process cartridge to be mounted to an electrophotographic apparatus according to aspects of the present invention.

The conductive surface layer 4 may be incorporated with a conductivity-imparting agent so that the resistance can be adjusted in an appropriate range. The volume resistivity of the conductive surface layer 4 is usually adjusted in the range of $10^3$ to $10^{10}$ ohm. In the present invention, it is essential to use an acidic carbon black as the conductivity-imparting agent for the conductive surface layer 4. In particular, by adjusting the pH to 2.0 to 5.0, the interactions between the carboxyl groups of the conductive surface layer 4 and the basic carbon black contained in the conductive elastic layer 3 can be increased, which is desirable. Furthermore, as long as an acidic carbon black is used, the type of carbon black is not particularly limited, and conductive carbon black, carbon black for rubber, or carbon for color (ink) may be used. The amount of the acidic carbon black contained in the conductive surface layer is usually in the rage of 1.0 to 50 parts by mass relative to 100 parts by mass of the base material. Electrophotographic process cartridge and electrophotographic apparatus FIG. 3 is a cross-sectional view schematically showing an electrophotographic apparatus according to aspects of the present invention. FIG. 4 is an enlarged cross-sectional view showing an electrophotographic process cartridge to be mounted to the electrophotographic apparatus shown in FIG. 3. The electrophotographic process cartridge includes an image bearing member 21 as an image bearing member, a charging unit provided with a charging member 22, a developing unit provided with a development roller 24, and a cleaning unit provided with a cleaning member 30, which are built therein. The electrophotographic process cartridge is configured to be detachably mountable to a main body of the electrophotographic apparatus shown in FIG. 3.

The image bearing member 21 is uniformly charged (primary charging) by the charging member 22 connected to a bias power source (not shown). In this stage, the charge potential of the image bearing member 21 is −800 to −400 V. Next, the image bearing member 21 is irradiated with exposure light 23 for forming an electrostatic latent image by an exposing unit (not shown), and the electrostatic latent image is formed on the surface thereof. As the exposure light 23, either LED light or laser light can be used. The surface potential of the exposed portion of the image bearing member 21 is −200 to −100 V.

Next, a toner negatively charged by the development roller 24 is applied to the electrostatic latent image (developed), and a toner image is formed on the image bearing member 21. Thus, the electrostatic latent image is converted into a visible image. In this stage, a voltage of −500 to −300 V is applied to the development roller 24 by a bias power source (not shown). Note that the development roller 24 is in contact with the image bearing member 21 with a nip width of 0.5 to 3 mm. In the electrophotographic process cartridge according to aspects of the present invention, a toner feed roller 25 is brought into contact with the development roller 24 in a rotatable manner on the upstream side of the rotation of the development roller 24 with respect to the contact portion between the development blade 26 which is a toner regulation member and the development roller 24. Primary transfer of the toner image developed on the image bearing member 21 is carried out onto an intermediate transfer belt 27. A primary transfer member 28 is in contact with the back surface of the intermediate transfer belt 27. By applying a voltage of +100 to +1,500 V to the primary transfer member 28, primary transfer of the negatively charged toner image is carried out from the image bearing member 21 to the intermediate transfer belt 27. The primary transfer member 28 may be roller-shaped or blade-shaped.

In the case where an electrophotographic image forming apparatus is a full-color image forming apparatus, the charging, exposure, development, and primary transfer steps described above are repeated with respect to each color of yellow, cyan, magenta, and black. For that purpose, in the electrophotographic apparatus shown in FIG. 3, four process cartridges storing toners of the individual colors are detachably mounted to the main body of the electrophotographic apparatus. The charging, exposure, development, and primary transfer steps described above are sequentially performed at predetermined time intervals. In such a manner, 4-color toner images for displaying a full color image are superposed on the intermediate transfer belt 27.

The toner images on the intermediate transfer belt 27 are transferred to a position facing a secondary transfer member 29 by rotation of the intermediate transfer belt 27. Recording paper is conveyed between the intermediate transfer belt 27 and the secondary transfer member 29 at a predetermined timing along a recording paper conveying route 32. By applying a secondary transfer bias voltage to the secondary transfer member 29, the toner images on the intermediate transfer belt 27 are transferred onto the transfer medium (recording paper). The bias voltage to be applied to the secondary transfer member 29 is +1,000 to +4,000 V. The recording paper onto which the toner images have been transferred by the secondary transfer member 29 is conveyed to a fixing unit 31. The toner images on the recording paper are fused and fixed on the recording paper, and then the recording paper is discharged out of the electrophotographic image forming apparatus. Thereby, the printing operation is completed.

Portions of the toner images which have not been transferred from the image bearing member 21 to the intermediate transfer belt 27 and have remained on the image bearing member 21 are scraped off by a cleaning member 30 configured to clean the surface of the image bearing member 21, and thus the surface of the image bearing member 21 is cleaned.

EXAMPLES

Aspects of the present invention will be described in more detail below on the basis of examples and comparative examples. The carbon blacks used in examples and the pH values of the carbon blacks measured in accordance with the method described above are shown in Table 1.

TABLE 1

| | |
|---|---|
| Trade name: #2700 manufactured by Mitsubishi Chemical Corporation | pH = 2.0 |
| Trade name: Printex150T manufactured by Degussa AG | pH = 4.1 |
| Trade name: TOKABLACK # 8300F manufactured by Tokai Carbon Co., Ltd. | pH = 5.2 |
| Trade name: #970 manufactured by Mitsubishi Chemical Corporation | pH = 8.3 |
| Trade name: Printex45 manufactured by Degussa AG | pH = 9.0 |
| Trade name: Printex60 manufactured by Degussa AG | pH = 10.1 |

Production of Conductive Elastic Layer (Production of Conductive Elastic Layer 1)

The materials shown in Table 2 were mixed at room temperature using a stirrer. Thereby, a conductive composition 1 was produced.

TABLE 2

| | |
|---|---|
| Vinyl-terminated polysiloxane (trade name: "DMS-V42" manufactured by AZmax Co., Ltd.) | 100 parts by mass |
| Hydrosilylation crosslinking agent (trade name: "HMS-151" manufactured by AZmax Co., Ltd.) | 5.4 parts by mass |
| Platinum catalyst (trade name: "SIP6831-3" manufactured by AZmax Co., Ltd.) | 0.15 parts by mass |
| Carbon black (trade name: #970 manufactured by Mitsubishi Chemical Corporation) | 8.0 parts by mass |

Next, a core metal made of SUS304 with a diameter of 6 mm was coated with a primer (trade name: "DY35-051" manufactured by Dow Corning Toray Silicone Co., Ltd.), followed by baking at 150 degrees Celsius for 30 minutes. The resulting workpiece was placed in a mold. The semi-conducting composition 1 was poured into a cavity in the mold. Subsequently, the mold was heated at 150 degrees Celsius for 15 minutes. The resulting product was removed from the mold, and then heated at 200 degrees Celsius for 2 hours to complete the curing reaction. Thereby, a conductive elastic layer 1 with a diameter of 12 mm was produced.

(Production of Conductive Elastic Layer 2)

A conductive elastic layer 2 was produced in the same manner as that described above except that the carbon black (trade name "#970" manufactured by Mitsubishi Chemical Corporation) of the conductive elastic layer 1 was changed to a carbon black (trade name "Printex45" manufactured by Degussa AG).

(Production of Conductive Elastic Layer 3)

A conductive elastic layer 3 was produced in the same manner except that the carbon black (trade name "#970" manufactured by Mitsubishi Chemical Corporation) of the conductive elastic layer 1 was changed to a carbon black (trade name: "Printex60" manufactured by Degussa AG).

(Production of Conductive Elastic Layer 4)

A conductive elastic layer 4 was produced in the same manner except that the carbon black (trade name "#970" manufactured by Mitsubishi Chemical Corporation) of the conductive elastic layer 1 was changed to a carbon black (trade name: "TOKABLACK #8300F" manufactured by Tokai Carbon Co., Ltd).

Production of Coating Material for Forming Conductive Surface Layer (Production of Coating Material 1)

In a four-necked separable flask equipped with a stirrer, a condenser, a thermometer, and a nitrogen introduction tube, the materials shown in Table 3 were placed, and while stirring, a reaction was allowed to take place in a nitrogen atmosphere at 80 degrees Celsius for 5 hours. Then, the solvent was removed, and a urethane prepolymer 1 having a carboxyl group in its molecule was obtained. The materials shown in Table 4 including the resulting urethane prepolymer 1 were stirred and dispersed with a ball mill to prepare a coating material 1.

TABLE 3

| | |
|---|---|
| Polyol (trade name: "PTG1000" manufactured by Hodogaya Chemical Co., Ltd. | 250 parts by mass |
| Dimethylolpropionic acid (manufactured by Aldrich Company) | 20 parts by mass |
| 4,4'-Diphenylmethane diisocyanate (manufactured by Aldrich Company) | 100 parts by mass |
| Methyl ethyl ketone | 1000 parts by mass |

TABLE 4

| | |
|---|---|
| Urethane prepolymer 1 | 150 parts by mass |
| Polyol (trade name: "NIPPOLLAN 4010" manufactured by Nippon Polyurethane Industry Co., Ltd.) | 100 parts by mass |
| Carbon black (trade name: "#2700" manufactured by Mitsubishi Chemical Corporation) | 30 parts by mass |
| Acrylic resin particles (trade name: "MX-1000" manufactured by Soken Chemical & Engineering Co., Ltd.) | 30 parts by mass |

(Production of Coating Material 2)

A coating material 2 was prepared in the same manner as described above except that the carbon black (trade name: "#2700" manufactured by Mitsubishi Chemical Corporation) of the coating material 1 of the conductive surface layer was changed to a carbon black (trade name: "Printex150T" manufactured by Degussa AG).

(Production of Coating Material 3)

A coating material 3 was prepared in the same manner except that the carbon black (trade name: "#2700" manufactured by Mitsubishi Chemical Corporation) of the coating material 1 of the conductive surface layer was changed to a carbon black (trade name: "TOKABLACK #8300F" manufactured by Tokai Carbon Co., Ltd).

(Production of Coating Material 4)

A coating material 4 was prepared in the same manner except that the carbon black (trade name: "#2700" manufactured by Mitsubishi Chemical Corporation) of the coating material 1 of the conductive surface layer was changed to a carbon black (trade name: "#970" manufactured by Mitsubishi Chemical Corporation).

(Production of Coating Material 5)

The materials shown in Table 5 were reacted at 80 degrees Celsius for 5 hours to obtain a urethane prepolymer 2. The materials shown in Table 6 including the resulting urethane prepolymer 2 were stirred and dispersed with a ball mill to prepare a coating material 5 of a conductive surface layer.

TABLE 5

| | |
|---|---|
| Polyol (trade name: "PTG1000" manufactured by Hodogaya Chemical Co., Ltd. | 250 parts by mass |
| 4,4'-diphenylmethane diisocyanate (manufactured by Aldrich Company) | 60 parts by mass |

TABLE 6

| | |
|---|---|
| Urethane prepolymer 2 | 150 parts by mass |
| Polyol (trade name: "NIPPOLLAN 4010" manufactured by Nippon Polyurethane Industry Co., Ltd.) | 100 parts by mass |
| Carbon black (trade name: "TOKABLACK #8300F" manufactured by Tokai Carbon Co., Ltd. | 30 parts by mass |
| Acrylic resin particles (trade name: "MX-1000" manufactured by Soken Chemical & Engineering Co., Ltd.) | 30 parts by mass |

(Production of Coating Material 6)

In a four-necked separable flask equipped with a stirrer, a condenser, a thermometer, and a nitrogen introduction tube, the materials shown in Table 7 were placed, and while stirring, solution polymerization was performed in a nitrogen atmosphere at 80 degrees Celsius for 8 hours to obtain a carboxyl-containing acrylic resin solution 1. The materials shown in Table 8 including the resulting acrylic resin solution 1 were stirred and dispersed with a ball mill to prepare a coating material 6.

TABLE 7

| | |
|---|---|
| 2-Ethylhexyl methacrylate (manufactured by Aldrich Company) | 20 parts by mass |
| 2-(Acryloyloxy)ethyl succinate (manufactured by Aldrich Company) | 5 parts by mass |
| Toluene | 40 parts by mass |
| Dimethyl 2,2'-azobis(2-methylpropionate) (manufactured by Aldrich Company) | 2 parts by mass |

TABLE 8

| | |
|---|---|
| Urethane prepolymer 2 | 150 parts by mass |
| Polyol (trade name: "NIPPOLLAN 4010" manufactured by Nippon Polyurethane Industry Co., Ltd.) | 100 parts by mass |
| carboxyl-containing acrylic resin solution 1 | 30 parts by mass |
| Carbon black (trade name: "TOKABLACK #8300F" manufactured by Tokai Carbon Co., Ltd. | 30 parts by mass |
| Acrylic resin particles (trade name: "MX-1000" manufactured by Soken Chemical & Engineering Co., Ltd.) | 30 parts by mass |

Production of Development Roller (Production of Development Rollers 1 to 12)

Methyl ethyl ketone was added to the coating material of each conductive surface layer to adjust the solid content to 28%. The molded conductive elastic layers were dip-coated with the coating material in the combination shown in Table 9 below. After drying was performed for 15 minutes in an oven at 80 degrees Celsius, curing was performed for 4 hours in an oven at 140 degrees Celsius. Thereby, resin layers as conductive surface layers were formed, and thus development rollers were obtained.

TABLE 9

| | Conductive elastic layer | Coating material No. |
|---|---|---|
| Development Roller 1 | 1 | 3 |
| Development Roller 2 | 1 | 1 |
| Development Roller 3 | 3 | 3 |
| Development Roller 4 | 2 | 2 |
| Development Roller 5 | 3 | 2 |
| Development Roller 6 | 2 | 1 |
| Development Roller 7 | 3 | 1 |
| Development Roller 8 | 1 | 5 |
| Development Roller 9 | 4 | 4 |
| Development Roller 10 | 4 | 3 |
| Development Roller 11 | 1 | 4 |
| Development Roller 12 | 1 | 6 |

Performance Evaluation

In order to compare the increases in resistance of the conductive rollers due to stress of a contact member, evaluation was performed in accordance with the following procedure:

(1) Each of the resulting conductive rollers was left to stand in an environment at 23 degrees Celsius and a humidity of 50% for 24 hours. Then, the resistance $R_0$ was obtained by the resistance measurement method described above in an environment at 23 degrees Celsius and a humidity of 50%.

Figure 5:
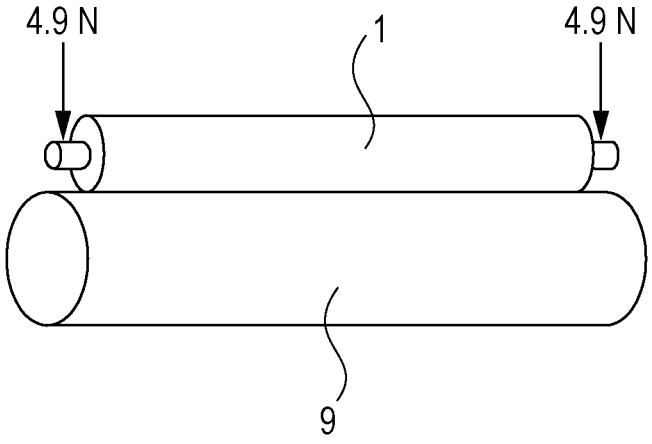
FIG. 5 is a view illustrating a jig configured to apply physical stress to a development roller according to aspects of the present invention.

(2) Physical stress was applied to the conductive roller with a jig shown in FIG. 5. Specifically, a weight of 4.9 N was applied to each end of the core metal of the conductive roller 1 in an environment at 23 degrees Celsius and a humidity of 50%, and the development roller 1 was pressed against a metal drum 9 with a diameter of 24 mm. Subsequently, the conductive roller 1 and the metal drum 9 were rotated in the forward direction at a peripheral speed of 160 mm/sec and at a peripheral speed of 100 mm/sec, respectively, and rotation was continued for 4 hours with the conductive roller 1 being slid on the metal drum 9.

(3) After physical stress was applied to the conductive roller as described above, the conductive roller was again left to stand in an environment at 23 degrees Celsius and a humidity of 50% for 24 hours. Then, the resistance $R_1$ of the conductive roller was obtained by the resistance measurement method described above in an environment at 23 degrees Celsius and a humidity of 50%.

(4) The ratio of change in electrical resistance before and after application of physical stress (R1/R0) was calculated.

Image Evaluation (Evaluation of Uneven Density in Halftone Image)

The conductive roller was installed as a development roller of a cyan electrophotographic process cartridge for a color laser printer (trade name: Color LaserJet 4700 manufactured by Hewlett-Packard Company). The electrophotographic process cartridge was mounted to the color laser printer, and an electrophotographic image was outputted.

Specifically, an image in which the letter of an alphabet "E" having a size of 4 points was formed on A4 size paper so as to have a print density of 2% was printed out on 15,000 sheets. Subsequently, a halftone image was outputted. The halftone image is an image in which horizontal lines each having a width of 1 dot are drawn at an interval of 2 dots in a direction perpendicular to the rotation direction of the electrophotographic photosensitive drum on A4 size paper.

Regarding the resulting halftone image, measurement was performed at 10 positions (10 positions that divide a line into 11 portions, the line dividing the halftone image into two halves sideways and being parallel to the paper discharge direction) with a Macbeth reflection densitometer (manufactured by Macbeth Company) using an SPI auxiliary filter. The density difference (MAX-MIN) between the maximum density (MAX) and the minimum density (MIN) were calculated from the values measured at 10 points, and the uneven density of the halftone image was evaluated on the basis of criteria shown in Table 10. The results of performance evaluation and image evaluation of the individual development rollers are shown in Table 11.

As the paper used for output, CLC (color laser copier) sheets (A4 sized, basis weight=81.4 g/m2) manufactured by CANON KABUSHIKI KAISHA were used. Furthermore, as the toner, the cyan toner stored in the cyan electrophotographic process cartridge of the color laser printer was used. Furthermore, the image output was performed in an environment at 23 degrees Celsius and a relative humidity of 50%.

TABLE 10

| | | |
|---|---|---|
| A | Density difference of 0.025 or less | Substantially no uneven density occurs. |
| B | Density difference exceeding 0.025 and 0.05 or less | No problem occurs although uneven density is recognized in image. |
| C | Density difference exceeding 0.05 | Some problem occurs in image. |

TABLE 11

| | Roller No. | Presence or absence of carboxyl group in urethane resin molecule of conductive surface layer | pH of carbon black of conductive elastic layer | pH of carbon black of conductive surface layer | Resistance change ratio (R1/R0) | Density difference | Evaluation |
|---|---|---|---|---|---|---|---|
| Example 1 | Development roller 1 | Present | 8.3 (basic) | 5.2 (acidic) | 1.67 | 0.045 | B |
| Example 2 | Development roller 2 | Present | 8.3 (basic) | 2.0 (acidic) | 1.58 | 0.036 | B |
| Example 3 | Development roller 3 | Present | 10.1 (basic) | 5.2 (acidic) | 1.55 | 0.037 | B |
| Example 4 | Development roller 4 | Present | 9.0 (basic) | 4.1 (acidic) | 1.24 | 0.020 | A |
| Example 5 | Development roller 5 | Present | 10.1 (basic) | 4.1 (acidic) | 1.25 | 0.021 | A |
| Example 6 | Development roller 6 | Present | 9.0 (basic) | 2.0 (acidic) | 1.23 | 0.020 | A |
| Example 7 | Development roller 7 | Present | 10.1 (basic) | 2.0 (acidic) | 1.21 | 0.019 | A |
| Comparative Example 1 | Development roller 8 | Absent | 8.3 (basic) | 5.2 (acidic) | 3.21 | 0.088 | C |
| Comparative Example 2 | Development roller 9 | Present | 5.2 (acidic) | 8.3 (basic) | 2.87 | 0.078 | C |
| Comparative Example 3 | Development roller 10 | Present | 5.2 (acidic) | 5.2 (acidic) | 2.66 | 0,072 | C |
| Comparative Example 4 | Development roller 11 | Present | 8.3 (basic) | 8.3 (basic) | 3.04 | 0.079 | C |
| Comparative Example 5 | Development roller 12 | Absent | 8.3 (basic) | 5.2 (acidic) | 3.81 | 0.091 | C |

As is evident from the results of Examples 1 to 7 shown in Table 11, in the case where the development rollers satisfying the requirements of the present invention are used, it is possible to suppress a variation in resistance due to physical stress from a contact member, and thus, an uneven density in the halftone image after repeated use can be prevented. In contrast, in the case where the urethane of the conductive surface layer does not have a carboxyl group in its molecule or in the case where the properties of the carbon black are different from those specified in the present invention, it is difficult to suppress a variation in resistance due to physical stress from a contact member, and an uneven density in the halftone image cannot be prevented effectively.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-190688, filed Sep. 1, 2011, which is hereby incorporated by reference herein in its entirety.

REFERENCE SIGNS LIST

1 Development roller
2 Conductive shaft core
3 Conductive elastic layer
4 Conductive surface layer
5 Metal drum
6 Power source
7 Voltmeter
8 Resistor
9 Metal drum
21 Image bearing member
22 Charging member
23 Exposure light
24 Development roller
25 Toner feed roller
26 Developing blade
27 Intermediate transfer belt
28 Primary transfer member
29 Secondary transfer member
30 Cleaning member
31 Fixing unit
32 Recording paper conveying route

The invention claimed is:

1. A conductive member which is used for electrophotography, the conductive member comprising:

a conductive shaft core;

a conductive elastic layer on the conductive shaft core; and a conductive surface layer on the conductive elastic layer, wherein:

the conductive elastic layer contains silicone rubber, and a basic carbon black dispersed in the silicone rubber, and the conductive surface layer contains a urethane resin having a carboxyl group in its molecule and an acidic carbon black dispersed in the urethane resin.

2. The conductive member according to claim 1, wherein the basic carbon black has a pH of 9.0 to 10.0, and the acidic carbon black has a pH of 2.0 to 5.0.

3. The conductive member according to claim 1, wherein the conductive member is a conductive roller having a shape of a roller.

4. An electrophotographic process cartridge comprising:

an image bearing member configured to bear an electrostatic latent image;

a charging unit configured to perform primary charging on the image bearing member;

a developing unit configured to form a toner image by developing the electrostatic latent image with a toner; and a cleaning unit configured to clean the surface of the image bearing member, the electrophotographic process cartridge being configured to be detachably mountable to a main body of an electrophotographic apparatus, wherein:

the developing unit has the conductive member according to claim 1.

5. An electrophotographic apparatus comprising:

an image bearing member configured to bear an electrostatic latent image;

a charging unit configured to perform primary charging on the image bearing member;

an exposing unit configured to form an electrostatic latent image on the image bearing member on which primary charging has been performed;

a developing unit configured to develop the electrostatic latent image with a toner to form a toner image; and a transferring unit configured to transfer the toner image to a transfer medium, wherein:

the developing unit has the conductive member according to claim 1.

* * * * *